US008967250B2

(12) United States Patent
Lisk

(10) Patent No.: US 8,967,250 B2
(45) Date of Patent: Mar. 3, 2015

(54) WELL PUMPING AND CONTROL SYSTEM

(76) Inventor: Mike Lisk, Cloudcroft, NM (US)

( * ) Notice: Subject to any disclaimer, the term of this patent is extended or adjusted under 35 U.S.C. 154(b) by 269 days.

(21) Appl. No.: 13/334,803

(22) Filed: Dec. 22, 2011

(65) Prior Publication Data

US 2012/0328453 A1 Dec. 27, 2012

Related U.S. Application Data

(63) Continuation-in-part of application No. 13/167,328, filed on Jun. 23, 2011, now Pat. No. 8,820,404.

(60) Provisional application No. 61/572,302, filed on Jun. 23, 2010.

(51) Int. Cl.
*E21B 47/00* (2012.01)
*F04B 23/02* (2006.01)
(Continued)

(52) U.S. Cl.
CPC ..... *F04B 23/02* (2013.01); *E21B 43/128* (2013.01); *F04D 13/10* (2013.01); *F04B 49/02* (2013.01); *F04D 15/0209* (2013.01); *F04B 49/06* (2013.01); *F04B 49/106* (2013.01); *F04B 2205/09* (2013.01)
USPC ..... 166/250.03; 166/54; 166/250.01; 417/40

(58) Field of Classification Search
CPC ..... F04B 23/02; F04B 49/102; F04B 49/06; F04B 49/106; F04B 2205/09; F04B 49/02; F04D 13/10; E21B 43/00; E21B 43/128; E21B 44/00; E21B 47/0008
USPC ..... 166/250.01, 250.03, 53, 54, 68.5, 64, 166/369, 250.15; 417/44.1, 43, 44.2, 53, 417/12, 64, 20, 36
See application file for complete search history.

(56) References Cited

U.S. PATENT DOCUMENTS 1,035,431 A 8/1912 Ericson
2,286,613 A 6/1942 Fuller
(Continued)

FOREIGN PATENT DOCUMENTS

JP 09189303 7/1997
JP 2001193140 7/2001
(Continued)

OTHER PUBLICATIONS

International Search Report and Written Opinion for PCT/US2011/041694 mailed Feb. 21, 2012.
(Continued)

*Primary Examiner* — Yong-Suk (Philip) Ro
(74) *Attorney, Agent, or Firm* — Womble Carlyle Sandridge & Rice, LLP

(57) ABSTRACT

A well pumping and control system that is capable of operating in a wide range of ambient conditions. The system automatically maintains fluid level in a fluid storage vessel, while protecting the pump and generator from operating in conditions outside preset operating parameters to prevent premature failure and reduce repair. By operating to pump fluid only when preset operating conditions exist, e.g. low fluid level, ambient temperature, etc., the system reduces labor, fuel, and maintenance operating costs to the owner, improves well pumping reliability and production, reduces generator fuel consumption, reduces emissions, and conserves ground water or liquid hydrocarbons, whichever is being pumped into the fluid storage vessel by the system.

24 Claims, 4 Drawing Sheets

(51) Int. Cl.

| | |
|---|---|
| ***E21B 43/12*** | (2006.01) |
| ***F04D 13/10*** | (2006.01) |
| ***F04B 49/02*** | (2006.01) |
| ***F04D 15/02*** | (2006.01) |
| ***F04B 49/06*** | (2006.01) |
| ***F04B 49/10*** | (2006.01) |

(56) References Cited

U.S. PATENT DOCUMENTS

| | | | | |
|---|---|---|---|---|
| 3,142,639 | A | 7/1964 | Baer | |
| 3,726,606 | A | 4/1973 | Peters | |
| 3,937,599 | A | 2/1976 | Thureau et al. | |
| 3,963,374 | A * | 6/1976 | Sullivan | 417/12 |
| 4,129,893 | A | 12/1978 | Angello | |
| 4,137,527 | A | 1/1979 | Tennenhouse | |
| 4,180,374 | A | 12/1979 | Bristow | |
| 4,545,335 | A | 10/1985 | Hayashi | |
| 4,744,344 | A | 5/1988 | Morozumi | |
| 4,857,755 | A | 8/1989 | Comstock | |
| 4,874,294 | A | 10/1989 | Karg | |
| 5,562,423 | A | 10/1996 | Orth | |
| 5,667,362 | A | 9/1997 | Murai et al. | |
| 5,718,269 | A | 2/1998 | McGarvey | |
| 5,731,687 | A | 3/1998 | Hirano et al. | |
| 5,775,877 | A | 7/1998 | Genz | |
| 6,149,390 | A | 11/2000 | Fisher | |
| 6,382,225 | B1 * | 5/2002 | Tipton | 137/1 |
| 6,498,462 | B2 | 12/2002 | Ballantine et al. | |
| 6,630,816 | B2 | 10/2003 | Kotani et al. | |
| 6,682,309 | B2 | 1/2004 | Reid | |
| 6,699,019 | B2 | 3/2004 | Myers et al. | |
| 6,766,620 | B2 | 7/2004 | Robbins | |
| 6,894,403 | B2 | 5/2005 | Shinogi | |
| 7,395,810 | B2 | 7/2008 | Miyashita et al. | |
| 8,167,578 | B2 | 5/2012 | Lin | |
| 8,550,038 | B2 | 10/2013 | Marlenee et al. | |
| 8,783,396 | B2 | 7/2014 | Bowman | |
| 8,788,177 | B2 | 7/2014 | Hashimoto et al. | |
| 8,806,853 | B2 | 8/2014 | Johnson et al. | |
| 2006/0112478 | A1 | 6/2006 | Kolar | |
| 2007/0204833 | A1 | 9/2007 | Miyashita et al. | |
| 2008/0217998 | A1 | 9/2008 | Parmley | |
| 2009/0200808 | A1 | 8/2009 | Parmley, Sr. | |
| 2010/0132351 | A1 | 6/2010 | Silvestro | |
| 2011/0248511 | A1 | 10/2011 | Marlenee et al. | |
| 2012/0251333 | A1 | 10/2012 | Irwin | |
| 2013/0006548 | A1 | 1/2013 | Zanetti et al. | |
| 2013/0158767 | A1 | 6/2013 | Araki | |
| 2013/0204512 | A1 | 8/2013 | Mizuno et al. | |
| 2014/0163796 | A1 | 6/2014 | Omi et al. | |
| 2014/0209312 | A1 | 7/2014 | Munisteri | |
| 2014/0216841 | A1 | 8/2014 | Winter et al. | |
| 2014/0261253 | A1 | 9/2014 | Wold | |

FOREIGN PATENT DOCUMENTS

| | | |
|---|---|---|
| JP | 2004108253 | 4/2004 |
| JP | 2010048020 | 3/2010 |
| KR | 2020100004835 | 5/2010 |
| WO | WO 01-21429 A1 | 3/2001 |

OTHER PUBLICATIONS

International Search Report and Written Opinion for PCT/US2012/054617 dated Mar. 8, 2013.

Producers Can Go Off Grid With Propane System, The Western Producer, posted Sep. 26, 2014 by Ron Lyseng, http://www.producer.com/2014/09/producers-can-go-off-grid-with-propane-system/ 7 pages.

File history of U.S. Appl. No. 13/847,629, filed Mar. 20, 2013.

* cited by examiner

WELL PUMPING AND CONTROL SYSTEM

CROSS REFERENCE TO RELATED APPLICATION

The present application is a continuation-in-part application of U.S. patent application Ser. No. 13/167,328, filed Jun. 23, 2011, now U.S. Pat. No. 8,820,404 which claims priority and benefit to Provisional Application No. 61/572,302, which was originally filed as U.S. Nonprovisional patent application Ser. No. 12/822,077, on Jun. 23, 2010, but which was converted to a provisional application. The entirety of the disclosures, including specifications and drawings, of the applications filed on Jun. 23, 2010 and Jun. 23, 2011 are specifically incorporated herein by reference as if set forth in their entirety.

BACKGROUND OF THE INVENTION

1. Field of the Invention

The present invention relates to an intelligent well pumping and control system which monitors fluid levels typically at wells in remote locations such as hydrocarbon (oil, gas, etc.) wells or at livestock water wells generally at locations where utility power is not available. The present system monitors and analyzes critical equipment safety conditions as well as maintenance and production parameters controlling the fluid pumping process and then provides electrical power to a well pump on demand automatically without requiring an on-site operator.

2. Description of the Invention

Fluid production at remote wells has long been problematic in the livestock industry (water wells) and hydrocarbon production industry (e.g. oil wells). The problems with remote wells include typically low production rates of pumping systems on deep wells, high failure rates of pumps and other components, high maintenance costs, and access challenges of typical wells. In order to address these problems, many within the livestock industry, for example, have resorted to solar powered wells, windmills, or point of use generators which require repeated trips to the remote well site to fuel and start the generator to maintain the pump to provide the water required to meet the production needs, based generally on livestock demand.

While solar power has been applied to wells supplying water for the livestock industry, solar powered pumping systems suffer from low flow rates on deep wells when compared to the flow rates of a standard deep well pump supported by AC electrical power. Solar energy production is also limited to location since it is dependent on exposure to sunlight, with fluid production capabilities decreasing or ceasing in extended periods of low or no sunlight. In some cases, the production rate of a solar production system is the primary limiting factor restricting a property from realizing its full potential, e.g. a livestock property having enough acreage to feed more livestock, but being limited in the number of livestock because of adequate, reliable water production. Additionally, solar production systems often do not utilize level control and result in pumped water that exceeds the capacity of the onsite water storage vessel to spill out of the vessel and be wasted.

Windmills have also been used at remote well sites, but are typically very wasteful when producing water. Conventional well windmills have wind driven shafts that mechanically actuate the pumping mechanism. Unless turned off by an operator, windmills pump as long as wind is present. Similar to excess sunlight with solar wells, excess wind can cause spillage of pumped water and generally results in overflowing water spilling out onto the ground, wasting the water and the operating efforts of the windmill. Windmills also tend to be expensive and difficult to maintain, often presenting risky and hazardous conditions to the technician performing maintenance.

The point of use generator, though typically the least expensive up front, can over the long run be a very expensive approach to water, hydrocarbon, or other fluid production. A generator typically requires an operator make a trip to the site with a container of fuel, fuel the generator, and then start the generator along with the deep well pump in the well. Typically, the operator then leaves the site and does not wait at the site the several hours that it takes the generator to consume the fuel, but leaves the site understanding that when the generator has consumed all of the fuel, it will stop running. Allowing the generator to run out of fuel under an electrical load in this manner is extremely hazardous to both the generator and the deep well pump, often shortening the operating life of each piece. This practice can further lead to expensive repairs or early replacements of either the generator or the well pump. Additionally, similar to solar and windmill powered systems in the livestock industry, allowing the generator to run risks excess produced water spilling onto the ground. While a generator in a hydrocarbon well can include a level switch that turns off the pump when fluid in the tank reaches a certain level, current hydrocarbon generator systems continue to operate the generator, even after the pump has switched off due to a full tank indication, until either the generator runs out of fuel or until an operator turns the generator off.

U.S. Pat. Nos. 4,744,334 and 1,632,188 and 6,699,019 describe methods and apparatus for the pumping and transfer of ground water to the surface for livestock consumption needs. The invention disclosed in U.S. Pat. No. 4,744,334 generally suffers from a limited water production capability as compared to the present invention. The windmill water pumping inventions disclosed in U.S. Pat. Nos. 1,632,188 and 6,699,019 suffer in areas of accessibility for maintenance, operational dependability, cost of repairs and water conservation when compared to the present invention.

SUMMARY OF THE INVENTION

The present invention is directed to a well pumping and control system, which comprises an electric power supply such as a propane or other, similar fuel combustion engine driven electricity generator and one or more field sensors to automatically produce an on-demand electrical power supply sufficient to support an in-ground well pump for filling a fluid storage vessel to a predetermined level, while continuously monitoring the fluid level in the storage vessel with the field sensors monitoring critical operating and environmental conditions and analyzing the conditions to control system operation, to improve operational efficiency and to prevent hazards to both pump and generator. The present invention further includes the capability to provide an alert or notification, for example, maintenance or troubleshooting messages or system status. The alert or notification can be displayed on an LCD screen at the control panel, or can be relayed to a location remote from the system, such as a text message, e-mail or other notification sent to an operator. The present invention thus can reduce fuel consumption and emissions due to the repeated frequencies of trips to well sites and/or due to an unmanned generator, increase desired fluid production, and, in the case of water wells, prevent unnecessary waste of ground water, all of which benefits the natural environment and reduces user operating costs. As used herein, the term "fluid" means any liquid substance that may be pumped and stored at remote sites including without limitation ground water, frac water, waste materials, liquid hydrocarbons such as crude oil, and the like, or mixtures thereof. The term "production" as used herein includes production from naturally occurring fluid sources such as ground water and oil, as well as recovery of non-naturally introduced fluids the removal of which is desired.

It is therefore an object of this present invention to provide a well pumping and control system which will significantly enhance fluid production capabilities at remote well sites where utility power is not available.

It is another object of this present invention to provide a well pumping and control system which will significantly enhance the reliability of fluid production at a remote well site.

It is a further object of this present invention to provide a well pumping and control system which can improve fuel efficiency, reduce undesirable emissions from vehicular traffic to a well site and from unmanned generators, and, for water wells, conserve ground water resources.

It is a still another object of this present invention to provide a well pumping and control system which reduces or eliminates health and safety hazards associated with technicians performing maintenance tasks on a windmill water production system at remote locations.

It is a still another object of this present invention to provide a well pumping and control system which can provide a durable, efficient and dependable fluid production system for remote well sites, preferably using a domestically produced, environmentally friendly fuel.

It is still another object of this present invention to provide a method of improving an existing well pumping system with a control system that improves the efficiency of the pumping system.

The present invention provides a well pumping and control system that includes an electricity power supply, a system control, a fluid storage vessel, a well pump that provides fluid to the fluid storage vessel, and a monitoring device for monitoring: i) the fluid level in the fluid storage vessel, ii) a flow rate of the pump, and iii) operating conditions of the power supply. The electricity power supply is any power supply capable of delivering sufficient electricity to safely power the well pump at operational depth. Many advantages of the present pumping and control system, however, are realized in locations where electrical utility lines are unavailable. In these locations, off-line electrical power supplies, such as combustion engine driven generators, solar panels, wind turbines, or even hydroelectric generators, are necessary. Preferred among these are combustion engine driven generators. The monitoring device operates to relay the fluid level in the fluid storage vessel to the system control and starts the generator and the well pump when the fluid level reaches a preset low level. The system control monitors the generator and the well pump to protect against operation under low flow conditions or operation of the generator or pump during unsuitable operating parameters. If the system shuts down due to an operational error or fault condition, a troubleshooting message indicating any reasons for shutdown is provided. The monitoring device can be a float switch or a fluid pressure switch. The system can further include a means for monitoring pump discharge flow.

The system can further include at least one of the following: means for monitoring a fuel level and means for displaying a low fuel message, means for monitoring a maintenance parameter for the generator, such as operating oil level, and means for displaying a maintenance alert, such as a low operating oil message, means for monitoring ambient temperature and means for displaying a low ambient temperature message, means for monitoring a typical fill time of the storage vessel by monitoring the fluid flow rate from the pump, the quantity of fluid required to raise the fluid level to the high level, or the time elapsed between start and stop of the pump, or means for monitoring electrical output from the generator. If the ambient temperature is below freezing and if the system is idle, the system control prevents the pump from starting until the ambient temperature rises above freezing. The system control ceases operation of the pump and generator at an occurrence of one of the following: after the fuel level reaches a preset low fuel level, after a maintenance parameter is met or exceeded, such as after the operating oil level reaches a preset operating oil low level, after the typical fill time has elapsed without the monitoring device indicating the fluid level in the fluid storage vessel has reached the high level, or after an indication that the electrical output from the generator is outside a preset electrical output range. The system control displays a message at the occurrence of one of the following: after the fuel level reaches a preset low fuel level, indicating the generator requires fuel, after the operating oil level reaches a preset operating oil low level, indicating the generator requires operating oil, after the ambient temperature reaches a preset low ambient temperature, indicating the generator and pump should not be started, after the typical fill time has lapsed without the monitoring device indicating the fluid level in the fluid storage vessel has reached the high level, indicating a possible leak in the fluid storage vessel, or after an indication that the electrical output from the generator is outside a preset electrical output range, indicating an electrical error or malfunction.

The system control is preferably capable of storing and displaying at least one operating condition at the system or at least one remote location to which the system control has electronically transmitted it, or both. The operating condition can include one or more of the following: fluid production data, run time of the generator or pump, elapsed time between operation of the generator or pump, aggregate amount of fluid pumped, or maintenance time to clean an air filter, change operating oil, or change the spark plug of the generator. The operating condition can be displayed on an LCD screen at the system.

The present invention also includes a method of improving an existing well pumping system by providing such an existing well pumping system with the control system of the present invention to improve the efficiency of the well pumping system.

The present invention also includes a method of operating a well pumping and control system, with the system including an electric power supply such as a generator, a system control, a fluid storage vessel, a well pump that provides fluid to the fluid storage vessel, and a monitoring device for monitoring a fluid level in the fluid storage vessel, a flow rate of the pump, and at least one operating condition of the generator. The method includes monitoring the fluid level in the fluid storage vessel with the monitoring device, and initiating operation of the generator and well pump when the fluid level reaches a preset low level. The monitoring can include the system control receiving a signal from a float switch or pressure switch to commence the system starting sequence. The system control generally initiates operation of the pump and the generator to pump fluid to fill the fluid storage vessel to a preset high level and then initiates a shutdown sequence of the generator and pump. The system then monitors operation of the pump. If the fluid flow is less than a preset flow rate, the method can further include stopping operation of the pump and generator by the system control. The method can further comprise relaying an error condition, such as to a remote location. The method can further include restarting the generator and the well pump after a preset time has elapsed.

The method can further include at least one of the following: monitoring a fuel level and displaying a low fuel message, monitoring an operating oil level and displaying a low operating oil message, monitoring ambient temperature and displaying a low ambient temperature message, monitoring a typical fill time of the storage vessel by monitoring the fluid flow rate from the pump, the quantity of fluid required to raise the fluid level to the high (full) level, or the time elapsed between start and stop of the pump, or monitoring electrical output from the generator. If the ambient temperature is below freezing and if the system is idle, the system control prevents the pump from starting until the ambient temperature rises above freezing. The system control ceases operation of the pump and generator at an occurrence of one of the following: after the fuel level reaches a preset low fuel level, after the operating oil level reaches a preset operating oil low level, after the typical fill time has elapsed without the monitoring device indicating the fluid level in the fluid vessel has reached the high level, or after an indication that the electrical output from the generator is outside a preset electrical output range.

The system control displays a message at the occurrence of one of the following: after the fuel level reaches a preset low fuel level, indicating the generator requires fuel, after the operating oil level reaches a preset operating oil low level, indicating the generator requires operating oil, after the ambient temperature reaches a preset low ambient temperature, indicating the generator and pump should not be started, after the typical fill time has elapsed without the monitoring device indicating the fluid level in the fluid vessel has reached the high (full) level, indicating a possible leak in the fluid storage vessel, or after an indication that the electrical output from the generator is outside a preset electrical output range, indicating an electrical error.

These and various other objects of the present invention will become apparent to those skilled in this art upon review the accompanying description, drawings, and claims set forth herein.

DETAILED DESCRIPTION OF THE INVENTION

Figure 1:
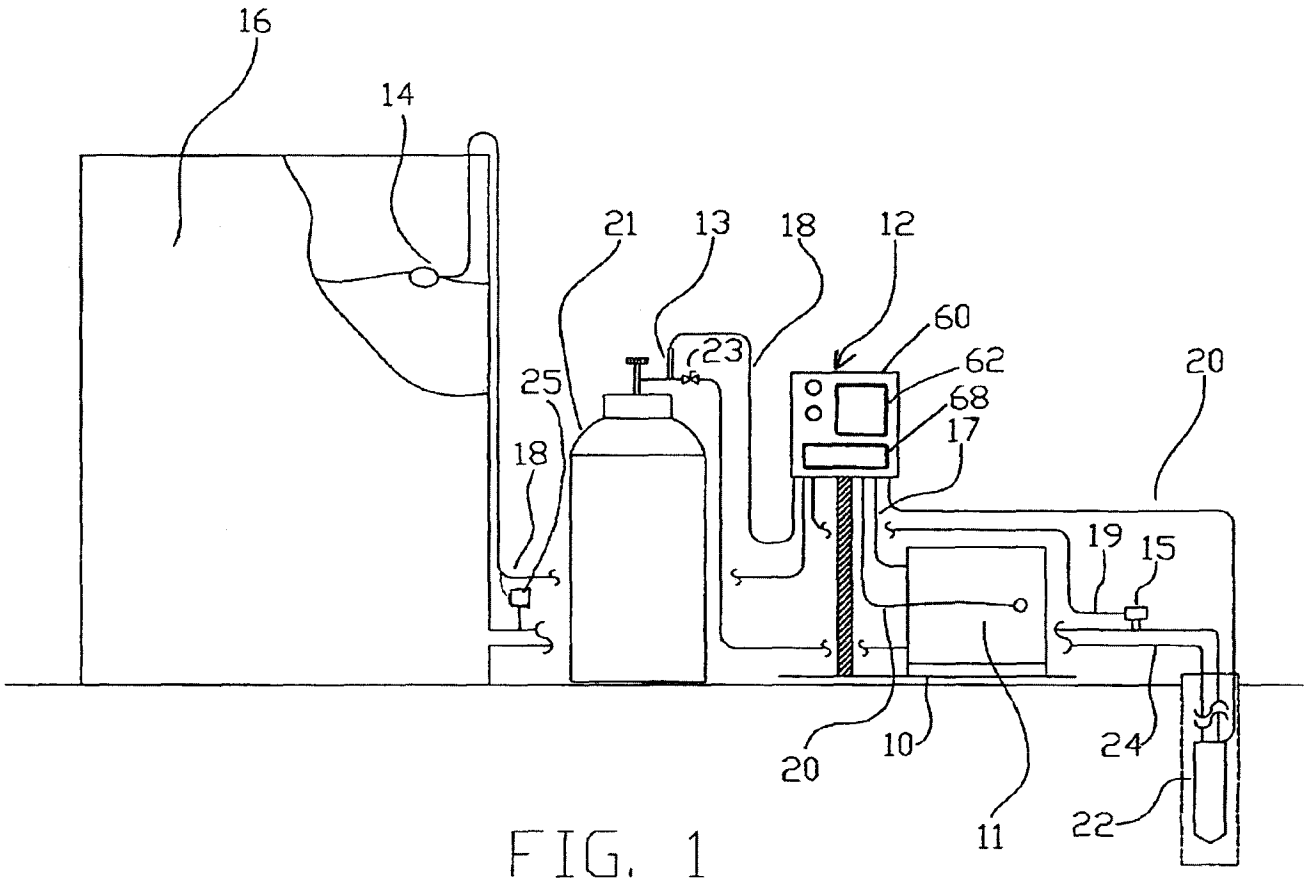
FIG. 1 is a front view schematically illustrating the well pumping and control system according to the present invention.
Figure 2:
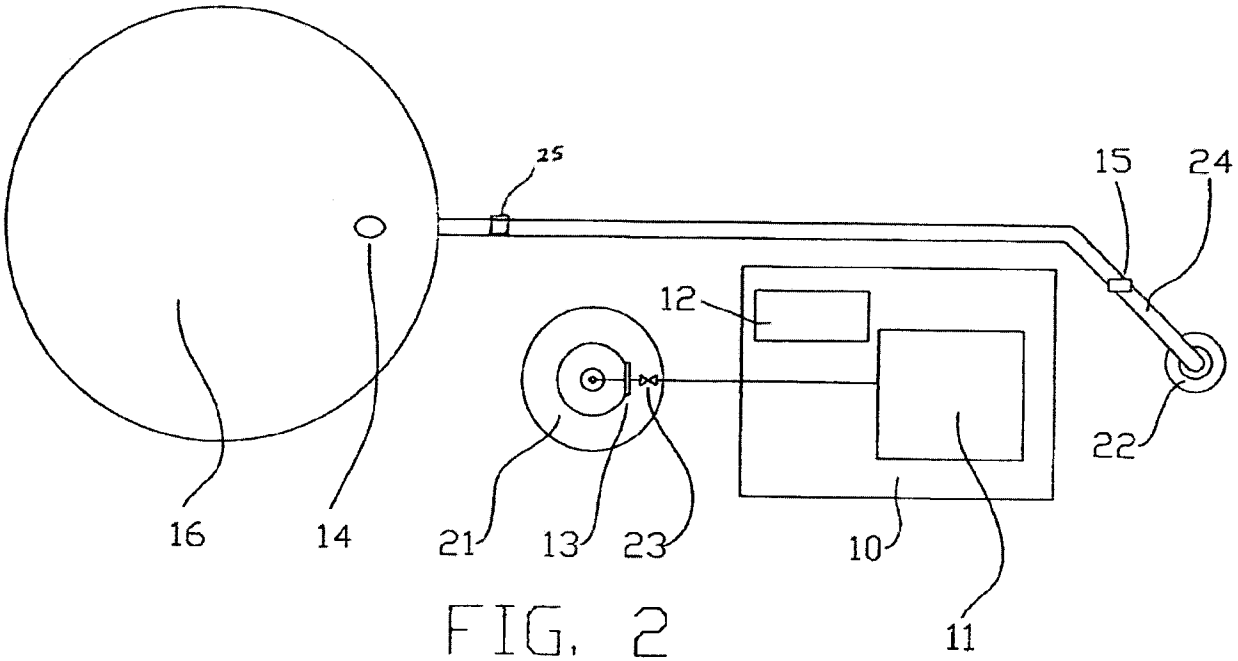
FIG. 2 is an overhead schematic view of the well pumping and control system.

A well pumping and control system is the overall system detailed herein. FIG. 1 illustrates one embodiment of the well pumping and control system according to the present invention. As seen in the drawings, the well pumping and control system comprises a control panel 12 and a generator 11 as the power supply, both of which are preferably mounted on a skid assembly 10. Generator 11 is preferably a combustion engine driven generator fueled by propane gas, diesel, or other suitable fuel that will accommodate the electrical power requirements of a well pump 22, which is preferably a deep underground well pump. An example of such an electric generator is the EcoGen series generators available from GENERAC Power Systems of Waukesha, Wis. System control panel 12 is electrically connected to generator 11 and well pump 22 by a properly sized cord and plug assembly 20 for the required electrical load necessary to run the generator and pump. The system control panel 12 is preferably a NEMA rated weather proof, hinged door enclosure. An example of a preferred enclosure for this application is a Hubbell, Wiegmann series NEMA-12 enclosure # B121206CH from Automation Direct in Cumming, Ga. Depicted inside control panel 12 is a display 62 and user input 68 (FIG. 3), such as a keyboard, touch screen, etc., and a system control or processor 60 that enables outputs and receives and monitors inputs from a series of field devices including a float switch 14 or a fluid pressure switch 25, a fuel pressure switch 13, and a flow switch 15 as can be seen on FIG. 2 of the drawings. The float, pressure, and flow switches serve to monitor pumping control variables and system status conditions for an outdoor application at a well site typically where utility power is not readily accessible, such as at sites of remote oil wells and livestock water wells. These switches report the system conditions to the system control panel, which in turn controls operation of the pump in response to such inputs to maintain the desired fluid level in fluid storage vessel 16.

The float switch 14 is placed in the target fluid storage vessel 16 or a pressure switch 25 is placed into the fluid pipe 24 between the well discharge and the fluid storage vessel 16 to monitor for predetermined low and full fluid level conditions. The float switch 14 can be any high quality, durable float actuated, magnetic or mechanical micro switch preferably rated for 12 volts DC or higher with a at least one set of normally open contacts, compatible with the ambient temperatures of the application. An example of a preferred fluid level float switch for this application would be a Dayton 3BY80 float switch. This switch is a durable switch compatible with the ambient temperatures of the application and is generally capable of greater than ten thousand cycles over its operating life, for example. The pressure switch 25 can be any type of durable liquid pressure sensing micro switch, with independent dual sets of normally open and normally closed contacts preferably rated for 12 volts DC or higher. An example of a preferred pressure switch for this application is a PSW-852CL pressure switch from OMEGA Engineering of Stamford, Conn. The pressure switch 25 is a durable switch compatible with the ambient temperatures of the application, and having a field settable hysteresis and set point repeatability of +/−2% and a greater than ten thousand cycle rated operating life. The float switch 14, or the pressure switch 25, is electrically connected to control panel 12 by an electrical quick change cable and receptacle assembly 18. An example of a preferred assembly is a Brad Harrison quick change cable and receptacle assembly model 112020A01F060 with a model 1R2006A20A120 receptacle and a model 1R2004A20A120 receptacle, all available from Brad Harrison/Woodhead Products distributed by Gross Automation, Brookfield, Wis.

When the float switch 14 or the pressure switch 25 detects a low fluid level condition in the fluid storage vessel 16, an electric signal is sent from the switch to control panel 12 (where the low fluid level signal is optionally confirmed by the system control after a preset time to confirm the actual low level condition). The system control panel 12 operates on a pre-programmed sequence, an example of which follows. Once a low fluid level condition in the fluid storage vessel 16 is detected and/or confirmed, the control panel 12 begins a system start up sequence with a start signal being sent to the generator 11. The generator 11 will receive a start signal from the system control panel 12, which will start the electric generator 11 and will produce adequate electric power to support an electric motor on an underground deep well pump 22. It will be appreciated that the control panel 12 battery (not shown) may not be sufficient to power the electric start of the generator 11, and that an auxiliary starter battery may be required.

Once the generator 11 has started, the ON condition of the generator will be confirmed at the system control panel 12 upon receiving a signal of the output from the generator 11. Once the generator output is confirmed at the system control panel 12, a preset run time can be allowed to elapse, allowing the engine of the generator 11 to warm up. After the preset warm up period runs, the system control panel 12 will turn on the electric power to the underground deep well pump 22, which can be any DC or sixty cycle AC electric motor driven submersible pump rated for the installation and compatible with the environmental conditions of the installation. The pump 22 is electrically connected to the system control panel by a cord and plug assembly 20, and produces a fluid flow from the underground deep well pump 22 through a fluid pipe 24 to the fluid storage vessel 16, filling the fluid storage vessel 16 to a predetermined full level as signaled by the float switch 14 position of, for example, 45 degrees above horizontal position, or the triggering of the pressure switch 25 pressure setting. When the fluid level in the fluid storage vessel 16 reaches a full condition as measured by the float switch 14 at a predetermined position or the pressure switch 25 at a preset pressure setting, a signal will be sent from the float switch 14 or the pressure switch 25 to the system control panel 12 to begin a controlled shutdown process of the underground deep well pump 22 and generator 11. In a preferred embodiment, the electrical supply to the well pump 22 will be turned OFF by the system control panel 12, but the generator 11 will continue to run for a preset time to allow the generator 11 to warm down with no load, and then automatically shut off ready for the next fill cycle process to begin.

A flow switch 15 is located in the fluid pipe 24 between the well discharge and the fluid storage vessel 16. An example of a mechanical flow switch is a Dwyer F.S.-2 vane flow switch available from DWYER Instruments Inc. of Michigan City, Ind., and an example of a thermally actuated flow switch for this application is a FST-211-SPST switch from OMEGA Engineering of Stamford, Conn. The flow switch 15 can be any temperature, magnetic or mechanically actuated micro switch, preferably rated for 12 volts DC or higher with at least one set of normally closed contacts capable of sensing the lowest fluid flow level of the installation. The flow switch 15 is durable and compatible with the ambient temperatures of the application, can have a field adjustable set point, and generally is rated as a greater than ten thousand cycle operating life. The flow switch is electrically connected to the system control panel 12 by an electrical quick change cable and receptacle assembly 19. An example of a preferred quick change cable and receptacle assembly is a Brad Harrison model 113020A01F060 cable with a model 1R3006A20A120 receptacle and a model 1R3004A20A120 receptacle, all available from Brad Harrison/Woodhead Products distributed by Gross Automation of Brookfield, Wis. The flow switch 15 will confirm fluid flow within a preset time after the well pump is turned ON. If no fluid flow is sensed by the flow switch 15 or if fluid flow stops for a preset time, then a signal will be sent from the flow switch 15 to the system control panel 12 to turn off the electrical power being supplied to the underground deep well pump 22 protecting it from operating in a no-flow condition due to a frozen fluid pipe 24, a weak fluid supply in the well or any other condition that could prevent fluid from flowing when the underground deep well pump 22 is ON.

An alarm or other fault condition notification can be sent to display a message, initiate a fault indicator, turn on a warning light, or otherwise initiate a localized display, for example, via text message, email message, or other indicator on the LCD screen 62 inside the system control panel 12 to indicate the no-flow condition and can be automatically forwarded to a central control or operator, such as wirelessly, via e-mail, text, or other notification. After a preset time period has elapsed to allow a well to recharge with ground fluid seepage or to allow frozen fluid pipes 24 to thaw, the system control panel 12 will automatically initiate a new start up sequence, while continuing to monitor the pump condition by means of the flow switch 15 to protect the system. This sequence will repeat until the fluid storage vessel 16 has reached a full level as measured by the float switch 14 in the fluid storage vessel 16 or the pressure switch 25 in the fluid pipe. A reset button inside the system control panel 12 thereafter can reset the text message and the well pumping and control system 10, clearing the condition and allowing immediate operation but still monitoring any no flow condition reoccurrence.

To aid in the prevention of operating in a condition where a frozen supply pipe may be present, a temperature sensor located inside of the system control panel 12 will prevent the start up of the system anytime that the temperature has dropped below a set temperature (e.g. thirty two degrees Fahrenheit (32° F.) or below) and will not allow the system to begin a startup sequence until the temperature sensed inside the control panel 12 has risen to a set temperature (e.g. forty degrees Fahrenheit (40° F.)) or the system reset button inside the system control panel 12 is activated. A text message will be displayed of the condition on the LCD screen inside the system control panel 12 until the condition has cleared or the reset button inside the system control panel 12 has been activated.

Fuel pressure is monitored by a pressure switch 13, preferably with a Division 1 Hazardous rating with a least one set of normally closed contacts rated for 12 volts DC or higher, with an adjustable set point range from eight to thirty pounds per square inch, with at least a maximum working pressure rating of three hundred pounds per square inch and rated for outdoor installations. An example of a preferred pressure switch is a PSW-12T-AS switch available from Omega Engineering of Stamford, Conn. The pressure switch is electrically connected to control panel 12 by an electrical quick change cable and receptacle assembly 18. An example of a preferred quick change cable and receptacle assembly is a Brad Harrison model 112020A01F060 cable with a model 1R2006A20A120 receptacle and a model 1R2004A20A120 receptacle, all available from Brad Harrison/Woodhead Products distributed by Gross Automation of Brookfield, Wis.

The fuel pressure switch 13 is located between the propane tank 21, or other fuel supply, and the pressure regulator 23 supplying the electric generator 11. The fuel pressure switch 13 monitors the tank fuel level and senses a low fuel pressure condition, and will send a signal to the system control panel 12 to initiate a shutdown sequence when the fuel pressure drops to the set point of the pressure switch 13 while the system is running. Once a low fuel pressure level is sensed, a text message of the condition will be displayed on the LCD screen inside the system control panel 12 and the system will be prevented from restarting until the system is refueled to an adequate pressure above the pressure switch 13 set point and the system reset button inside the system control panel 12 is activated, clearing the condition and the text message.

The system control panel 12 further can display on the LCD screen 62 a series of maintenance text prompts, including air filter, operating oil, or spark plug change after a predetermined time, for example five hundred hours of operation. All maintenance text prompts are preferably based on operating hour interval times recommended by the manufacturer of the generator 11. Such prompts generally will be programmed into the system control inside the system control panel 12, and a text message will be displayed on the LCD screen 62 at the end of the elapsed times to notify a technician/operator to perform the prompted task. These maintenance text prompts are resettable, e.g. by pressing the system reset button inside the system control panel 12.

The pumping and control system 10 will display on the LCD screen 62 inside the system control panel 12 operational text. Based on the measured flow rate of the pump 22 at the installation, a calculated value of total gallons of fluid collected up to a maximum value, for example one million gallons, will be displayed as a default on the LCD screen. In one embodiment, this total value is not resettable by an operator. Once the system has totaled the exemplary one million gallons of fluid produced, the value will reset to zero and start counting up to one million gallons again, repeating this cycle throughout the system's life. A second fluid production value will optionally be displayed on the LCD screen inside the system control panel 12 as a secondary default screen, displaying total gallons of fluid pumped since last reset. This is to allow an operator to quantify gallons of fluid produced between visits to the well site. In one example operation, a counter is reset to zero, e.g. by pressing the system reset button inside the system control panel 12 for a preset duration, for example five seconds. After initiating reset, the counter value will reset back to zero and will restart totaling gallons of fluid when the fluid production process starts again.

Calculations are made based on the fluid storage vessel 16 capacity of the measured underground deep well pump 22 discharge rate and the float switch 14 or the pressure switch 25 settings to determine the approximate time required for the deep well pump to fill the fluid storage vessel 16 to a desired or necessary level. The storage vessels 16 are installed on well sites as needed and generally range between 10,000 and 40,000 gallons. Storage reserves also range and depend on livestock loads (for water wells) and on capacity calculations (for hydrocarbon or other wells) and pump flows, and can range, for example, from a system that operates nearly every day for 8 hours or more to systems that operate once a week or less. Based on the calculations, a time value plus a selected percent of the calculated time will be inputted into the system control 60 inside on the system control panel 12. When the pump operating time with a confirmed flow at the flow switch 15 exceeds the inputted value, the system control panel 12 indicates that the system has exceeded a reasonable run time, prompting the operator to check for a leak in the piping system. In that situation, the system also generally will proceed through a shutdown sequence and will not restart until an operator has initiated a system reset, e.g. by pressing a system reset button inside the system control panel 12. This feature is intended to prevent the waste of fuel and preserve ground water or other target fluid.

Figure 3:
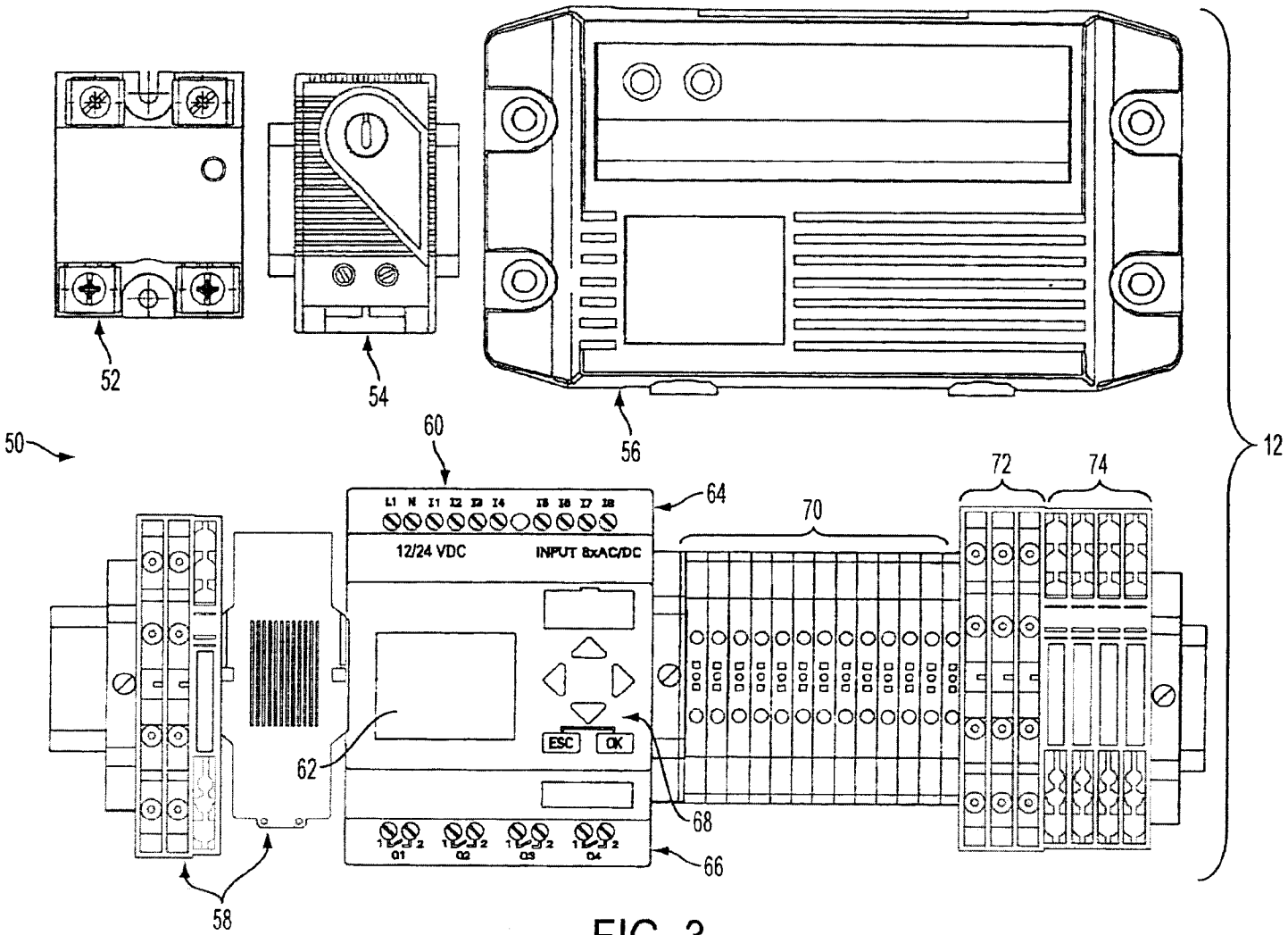
FIG. 3 is a front view of exemplary components in the control panel.

FIG. 3 is a front view of exemplary components in the control panel. FIG. 3 shows components of the interior 50 of control panel 12, including pump relay 52, thermostat 54, battery charger 56 for control panel battery and auxiliary starter battery (not shown), relays 58, controller 60, terminals 70, fuses 72, and relays 74. Controller 60 includes LCD screen 62, inputs 64, outputs 66, and user inputs 68 (such as keyboard, entry keys, etc.). Since additional or fewer components can be included in the interior 50 of control panel 12, the elements shown in FIG. 3 should not be limiting in any manner, and are provided as an exemplary configuration only.

Figure 4:
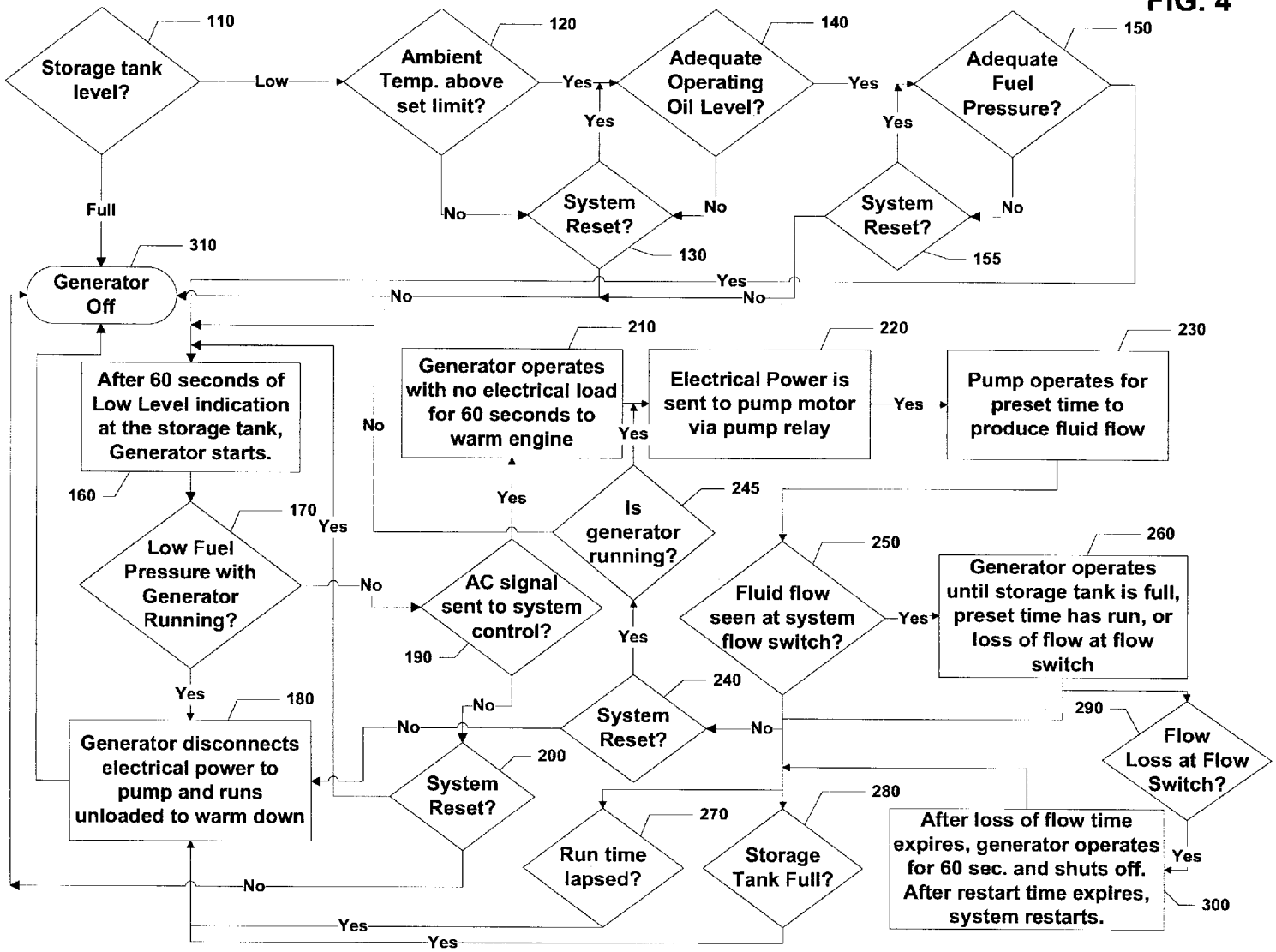
FIG. 4 is a flow chart showing an exemplary sequence of operation of the well pumping and control system.

FIG. 4 is a flow chart showing an exemplary sequence of operation of the well pumping and control system of the invention. The exemplary method includes a step 110 that analyzes the level of fluid level in the fluid storage vessel. If the fluid level indicates a full level, the generator remains off as shown in step 310. If the fluid level is indicated at a low level, the method proceeds from step 110 to step 120. At step 120, the ambient temperature surrounding the well pumping and control system is measured. If the ambient temperature is not above a preset level, (e.g. typically 32 degrees Fahrenheit for water wells), the method returns to step 310 with the generator remaining off. If the ambient temperature surrounding the well system is above the preset level, the method proceeds from step 120 to step 140. Alternatively, the method can be reset, such as by pressing a reset button as shown in step 130. The method then proceeds from step 130 to step 140. At step 140, the method measures the operating oil level. If the operating oil level at step 140 is below a preset level, the method returns to step 310 and the generator remains off. If the operating oil level is acceptable, the method proceeds from step 140 to step 150. Alternatively, the operating oil level indication can be reset such as indicated at step 130 and the method then returns to step 140 (thereby preventing the generator from starting if the oil level is too low). If operating oil is added (and reset is pressed at step 130), then the method proceeds from step 140 to step 150.

At step 150, the method measures the fuel pressure. If the fuel pressure is not adequate, the method proceeds to step 155 where the system can be reset (such as by pressing a button). If the system has not been reset at step 155, the method proceeds to step 310 and the generator remains off. If the system has been reset at step 155, the method returns to step 150 to measure the fuel pressure. If the fuel pressure is adequate, the method proceeds to step 160.

At step 160, the method measures a time interval that elapses to indicate a low fluid level at the fluid storage vessel. For example, as indicated at step 160, after sixty continuous seconds have lapsed, the generator will start and produce electric power. The method then will proceed from step 160 to step 170 where fuel pressure will be measured. If the fuel pressure level is low, the method proceeds from step 170 to step 180 with the generator disconnecting electrical power to the pump and the generator runs for sixty seconds to warm down and then proceeds from step 180 to step 310 to switch the generator off. If a low fuel pressure is not indicated at step 170, the method proceeds to step 190. At step 190, the AC electricity signal to the system control is monitored for two seconds. If a signal is indicated, the method proceeds from step 190 to step 210. If a signal is not indicated, the method proceeds from step 190 to step 200 to evaluate whether the system has been reset (such as by pressing a button). If the system has not been reset at step 200, the method proceeds to step 310 with the generator switching off. Alternatively, if the system has been reset, the method returns from step 190 to step 160.

At step 210, the generator preferably operates with no electrical load for sixty seconds to warm the engine and the method then proceeds to step 220. At step 220, electrical power is sent to the submersible pump motor by way of a system control pump relay and the method proceeds to step 230.

At step 230, the submersible pump operates for the preset time, preferably about sixty seconds, to produce fluid flow to confirm flow at the flow switch preventing continued operation in a no flow condition, such as a frozen pipe. The method then proceeds from step 230 to step 250 where fluid flow is monitored at the system flow switch. If fluid flow is not indicated at the system flow switch, the method proceeds from step 250 to step 180 as indicated above. Alternatively, if fluid flow is not measured at the system flow switch, the method can be reset as indicated at 240 and proceed to step 245 where the system control evaluates whether the generator is running. If the generator is running, the method returns to step 220 as indicated above. If the generator is not running, the method proceeds to step 160 once reset has occurred. If fluid flow is indicated at the system flow switch, the method proceeds from step 250 to step 260. At step 260, the generator operates and provides electrical power to the submersible pump motor until the storage tank indicates a full level, or until a preset allowed run time is elapsed, or until a loss of flow is indicated at the flow switch.

The method then proceeds from step 260 to either step 270, 280, or 290. If the allowed run time has elapsed, the method proceeds from step 260 to step 270. If the fluid storage tank indicates a full level, the method proceeds from step 260 to step 280. If step 260 indicates a loss of flow at the flow switch, the method proceeds from step 260 to step 290. If the allowed run time has elapsed at step 270, the method proceeds to step 180 as indicated above and then proceeds to switch off the generator at step 310. If at step 280 the fluid storage tank is full, the method proceeds to step 180 as indicated above and then proceeds to step 310 to switch the generator off. If a loss of flow at a flow switch is indicated at step 290, the method proceeds to step 300. At step 300, after the preset loss of flow time expires, the generator will operate for a preset time, preferably about sixty seconds, and shut off. Then, after a preset restart time has expired, the pumping process will be restarted and operated until the fluid storage tank indicates a full level. After step 300, the method proceeds from step 300 to step 280 to indicate that the fluid storage tank is full and then proceeds from step 280 to step 180 as detailed above and eventually to step 310 to switch the generator off.

The present well pumping and control system addresses several shortcomings of prior systems, including providing the ability to operate in both daylight and night hours along with significantly greater flow rates, giving the well pumping and control system of the present invention production capabilities that exceed those of wells supported by solar powered production systems, and potentially allowing the user of the well pumping and control system 10 opportunities for greater livestock grazing and production capabilities where water is currently a limiting factor or for greater oil production where generator operating limitations as discussed above are currently a limiting factor.

Operating the well pumping and control system of the present invention in place of a windmill production system will produce greater flow rates than windmill powered production systems and will prevent the waste of ground water in the livestock industry which is pumped from the ground to a storage vessel, since windmills have no level control capabilities. The maintenance of windmill production systems also can be very expensive and dangerous to the operator and technicians. Typical frequent maintenance tasks include replacement of the seals at the bottom of the well piping requiring the expense of several man hours and the use of a crane type vehicle. Servicing the gear box assembly at the top of the windmill pumping system tower requires a technician to climb high up to the top of the windmill tower or be raised to the area by some lifting device so that lubrication, operating oil change maintenance, and repairs to the gear box assembly, for example, can be performed. This service maintenance exposes a technician to the hazards of working in conditions at heights with tools, lubricants, and being subject to wind gusts that can create an extremely dangerous environment. By the use of the well pumping and control system of the present invention in place of windmill production system, the operator will realize a reduction in maintenance costs and the substantial elimination of the hazards of working at heights to the technicians, conceivably preventing injury and even death.

The use of the well pumping and control system of the present invention in place of a non-intelligent generator based system also can provide many additional advantages. A full command of the fluid production operation will be realized by using the well pumping and control system of the present invention. While reductions in labor and operating costs due to frequent trips to the well site to refuel and start the generator were objects of the invention, a substantial realized benefit to the operator is that the present well pumping and control system will monitor critical system dynamic conditions. Controlling the system functions to operate with respect to these conditions will result in safe operation to both the generator 11 and the underground deep well pump 22 and will prevent both generator 11 and underground deep well pump 22 from operating out of electrical design tolerance conditions such as over voltage, under voltage, low frequency, or the frequency of the generator shutting down under an electrical load (pump motor electrically connected).

The well pumping and control system of the present invention and methods of its use are most advantageously employed with fluid targets that periodically recharge. Ground water and oil, for example, may be found in sand, shale, or other strata through which the liquid must seep before it can be pumped to the surface. By monitoring fluid flow, the system will shut the pump down and, if applicable, turn off the generator when pumping becomes inefficient, as when the fluid level at the pump has been drawn down and needs to recharge. After a time, when the target fluid has had an opportunity to recharge, the system will automatically restart the pump.

It will also be appreciated by those skilled in the art, that while the preferred electricity power supply is a combustion engine driven generator, other off-line electricity power supplies, such as batteries, solar panels and wind turbines can also be used either alone or in combination with one another or with the preferred generator to power the system of the present invention. Sensors may be used to monitor the operating efficiency of the individual components of such a combination power supply, enabling the control system to automatically shift or combine sources of electricity to further enhance the overall efficiency of the system.

Most wells will have a rate at which the fluids in the ground recharge the well as fluid is removed from the well. Historically, pump selection is made to secure a pump flow rate that is less than the recharge rate of the targeted fluid. The control capabilities of the well pumping control system of the present invention allow the selection of a pump that generates a flow rate higher than the recharge rate because of the system's ability to sense a low flow condition due to a low fluid level in the well. Once a low flow condition occurs, the system will begin a controlled shutdown of the pumping process, which also typically includes turning the generator off. The system will then remain off for a preset time allowing the well to recharge with fluid. After the preset time has elapsed, the system will restart the pumping process. By replacing a first (typically the original) pump with a low fluid flow rate with a second (replacement) pump with a higher fluid flow rate than the first pump, the well pumping control system of the present invention can achieve a significant increase in production rates and at the same time a decrease in operating time.

EXAMPLE 1

The system of the present invention was implemented with an existing water well pumping water from a depth of seven hundred (700) feet. Before implementation of the system, the well was using a two (2) horsepower motor supporting a submersible pump, and was pumping at a rate of 4 gallons/min to generate a maximum of 5760 gallons of water per day with a fuel cost of one ($0.01) cent/gallon of water pumped. Electricity for this system was produced by a ten (10) kilowatt diesel fueled point of use generator. To implement the system, the point of use diesel generator was replaced with a 6 kilowatt propane fueled generator. The motor remained two (2) horsepower, but the four (4) gallon per minute submersible pump was replaced with a six (6) gallon per minute pump, an increase of fifty percent (50%) in the pumping rate. For this well, a "Pump Tech Plus" no load sensor available from Franklin Electric of Bluffton, Ind. was used. The no load sensor constantly senses the pump motor's electrical load (amps or power factor) and recognizes that a load below the set point corresponds to a lower fluid level in the well and automatically shuts power off to the pump protecting the pump from damage. When this occurs, the pumping control system detects a loss of flow at the flow switch installed in the piping and sends a signal to the system controller that a loss of flow has occurred. The controller then shuts down the generator for a preset time to allow the well to recharge. The production process changed this system's operation from a continuous flow process to a batch process. The system now operates for two (2) hours pumping fluid at six (6) gallons per minute. After two hours of pumping, the well reaches a low level and the system shuts down allowing a recharge time of forty (40) minutes. After the recharge time has elapsed the system restarts, and the cycle repeats until the storage vessel is full.

Implementation of the inventive system resulted in a twelve and one half percent (12.5%) increase in maximum daily production from 5760 gallons of water per day to 6480 gallons per day. Because of the fifty percent (50%) higher flow rate filling the storage tank, the run time necessary to operate the generator was decreased by thirty percent (30%) from sixteen (16) hours per day to eleven (11) hours per day. The fifty percent (50%) increase in flow and the preset off period along with a lower cost per gallon for propane resulted in a sixty percent (60%) reduction in fuel cost from $0.01 per gallon of water to $0.004 per gallon of water. The described well supports two hundred (200) lactating beef cows, each requiring twenty (20) gallons of water consumption per day in 95° F. temperatures (reference University of Arkansas Study by Professor Shane Gadberry FSA3021). This consumption rate totaled four thousand gallons (4000) per day. At a cost of $0.01 per gallon in diesel fuel cost the system operated at a cost of forty dollars ($40) per day. The installed pumping control system of the present invention produced the same four thousand (4000) gallons of water per day but at $0.004 per gallon in propane fuel cost for each gallon of water produced, or a cost of sixteen dollars ($16) daily. In addition, the increase in flow resulted in a decrease in operating time of thirty percent (30%). The shorter operating time dramatically lowered the cost of the pumping process. Those skilled in the art will appreciate that the preceding example further exemplifies the inventive method of providing the pumping control system of the present invention to an existing pumping system to improve its efficiency.

Those skilled in the art will further appreciate that the principles of the present invention demonstrated in the preceding water well example are equally applicable to other fluids, such as liquid hydrocarbons produced by oil and gas wells, and to other pumping systems.

EXAMPLE 2

The pumping control system of the invention was implemented to improve the efficiency of a conventional pump jack oil well. Such pump jacks typically do not utilize an electric pump and generally do not require a generator. Rather, they are driven directly by combustion engines, typically utilizing diesel fuel, propane, or natural gas collected from the well. For such a system, the control system of the present invention monitors flow rate of the pumped fluid and the fill level of the fluid storage vessel in the same manner as described above for a water well system. In the case of a pump jack system, monitoring of the power supply entails monitoring the combustion engine driving the pump jack rather than monitoring a generator or other source of electricity. Providing a new or existing pump jack system with the pumping control system of the present invention allows the pump jack to turn on and off depending on the recharge state of the liquid hydrocarbons in the well. By running the pump jack a shorter period of time while pumping at a higher flow rate, the production efficiency of the well is increased.

Thus it will be appreciated by those skilled in the art that the present invention is not restricted to the particular preferred embodiments described with reference to the drawings or the exemplified embodiments, and that variations may be made therein without departing from the scope of the present invention as defined in the appended claims and equivalents thereof.

What is claimed is:

1. A well pumping and control system for a ground well comprising:

a power supply;

a system control;

a fluid storage vessel;

a well pump that provides fluid from the ground well to the fluid storage vessel;

a fluid level monitoring device for monitoring a fluid level in the fluid storage vessel, a flow monitoring device for monitoring a fluid flow of the fluid provided by the pump, and an operating condition monitoring device for monitoring one or more operating conditions of the power supply;

wherein the fluid level monitoring device communicates the fluid level in the fluid storage vessel to the system control, wherein the flow monitoring device communicates the fluid flow provided by the pump to the system control, and wherein the system control turns the power supply on and starts the well pump when the fluid level reaches a preset low level and then turns the power supply off when no fluid flow is sensed by the flow monitoring device or when the fluid flow stops for a preset time.

2. The system of claim 1 wherein the power supply comprises a combustion engine driven generator, and wherein the system control automatically monitors the generator and the well pump to protect against operation under low flow conditions or operation of the generator or pump during unsuitable operating parameters.

3. The system of claim 2, wherein the fluid level monitoring device comprises a switch selected from a float switch and a pressure switch and the flow monitoring device comprises a flow switch.

4. The system of claim 2 further including at least one of the following: means for monitoring a fuel level and means for displaying a low fuel message, means for monitoring an operating oil level and means for displaying a low operating oil message, means for monitoring ambient temperature and means for displaying a low ambient temperature message, means for monitoring a typical fill time of the storage vessel by monitoring the fluid flow from the pump, the quantity of fluid required to raise the fluid level to the high level, or the time elapsed between start and stop of the pump, and means for monitoring electrical output from the generator.

5. The system of claim 4 wherein the system control ceases operation of the pump and generator at an occurrence of any one or more of the following: after the fuel level reaches a preset low fuel level, after the operating oil level reaches a preset operating oil low level, after the ambient temperature reaches a preset low ambient temperature, after the typical fill time has elapsed without the monitoring device indicating the fluid level in the fluid vessel has reached the high level, and after an indication that the electrical output from the generator is outside a preset electrical output range.

6. The system of claim 4 wherein the system control relays an error message, displays a message, or relays an error message and displays a message at the occurrence of any one or more of the following: after the fuel level reaches a preset low fuel level, after the operating oil level reaches a preset operating oil low level, after the ambient temperature reaches a preset low ambient temperature, after the typical fill time has elapsed without the monitoring device indicating the fluid level in the fluid vessel has reached the high level, and after an indication that the electrical output from the generator is outside a preset electrical output range.

7. The system of claim 2 wherein the system control is capable of storing and displaying at least one operating condition at the system or at least one remote location to which the system control has electronically transmitted it, or both.

8. The system of claim 7 wherein the operating condition includes one or more of the following: fluid production data, run time of the generator or pump, elapsed time of the generator or pump operation, aggregate amount of fluid pumped, and maintenance time to clean an air filter, operating oil, or spark plug of the generator.

9. The system of claim 1 wherein the fluid is a hydrocarbon.

10. The system of claim 1 wherein the system is solar powered and wherein the power supply is selected from the group consisting of: combustion engine generator, solar panels, wind turbines, or any combination of these.

11. The system of claim 10 wherein the power supply includes a generator and solar panels.

12. A method of operating a well pumping and control system for a ground well, the method comprising:

providing the system comprising a power supply, a system control, a fluid storage vessel, a well pump that provides fluid from the ground well to the fluid storage vessel, a fluid level monitoring device for monitoring a fluid level in the fluid storage vessel, a flow monitoring device for monitoring a fluid flow of the pump and communicating the fluid flow provided by the pump to the system control, and an operating condition monitoring device for monitoring one or more operating conditions of the power supply;

monitoring the fluid level in the fluid storage vessel with the fluid level monitoring device;

providing electricity from the power supply to the well pump;

initiating operation of well pump when the fluid level in the fluid storage vessel reaches a preset low level;

monitoring the power supply automatically with the system control to protect against operation of the power supply during unsuitable operating conditions; and, monitoring the pump automatically system control to protect against operation of the pump during unsuitable operating conditions;

wherein the system control turns the power supply off when no fluid flow is sensed by the flow monitoring device or when the fluid flow stops for a preset time.

13. The method of claim 12 wherein the monitoring of the fluid level in the fluid storage vessel includes the system control receiving a signal from a float switch to commence a system start sequence.

14. The method of claim 13 wherein the system control initiates operation of the generator and the pump to pump fluid to fill the fluid storage vessel to a preset high level and then initiates a shutdown sequence of the generator and pump.

15. The method of claim 14 wherein, if during operation of the pump, the fluid flow is less than a preset flow the method further comprises:

stopping operation of the pump and generator by the system control.

16. The method of claim 15 wherein the method further comprises:

displaying a system condition.

17. The method of claim 15 wherein the method further comprises:

restarting the system after a preset time has elapsed.

18. The method of claim 12 wherein the fluid is a hydrocarbon.

19. The method of claim 12 further including at least one of the following: monitoring a fuel level and displaying a low fuel message, monitoring an operating oil level and displaying a low operating oil message, monitoring ambient temperature and displaying a low ambient temperature message, monitoring a typical fill time of the storage vessel by monitoring the fluid flow from the pump, the quantity of fluid required to raise the fluid level to a preset high fluid level, or the time elapsed between start and stop of the pump, and monitoring electrical output from the generator.

20. The method of claim 19 wherein the system control ceases operation of the pump and generator at an occurrence of one of the following: after the fuel level reaches a preset low fuel level, after the operating oil level reaches a preset operating oil low level, after the ambient temperature reaches a preset low ambient temperature, after the typical fill time has lapsed without the monitoring device indicating the fluid level in the fluid storage vessel has reached the preset high fluid level, and after an indication that the electrical output from the generator is outside a preset electrical output range.

21. The method of claim 19 wherein the system control displays a message at the occurrence of one of the following: after the fuel level reaches a preset low fuel level, indicating the generator requires fuel, after the operating oil level reaches a preset operating oil low level, indicating the generator requires operating oil, after the ambient temperature reaches a preset low ambient temperature, indicating the generator and pump should not be run, after the typical fill time has lapsed without the monitoring device indicating the fluid level in the fluid storage vessel has reached the high level, indicating a possible leak or other problem with the fluid storage vessel, and after an indication that the electrical output from the generator is outside a preset electrical output range, indicating an electrical error.

22. A method of improving an existing ground well, the method comprising:

selecting the existing ground well; the existing ground well including at least a power supply and a pump connecting fluid in the ground to a fluid storage vessel; the pump producing a pump fluid flow from the ground well to the fluid storage vessel;

replacing the pump with a replacement pump that is capable of pumping at a replacement pump fluid flow that is greater than the pump fluid flow; and, providing a system control and a fluid level monitoring device for monitoring a fluid level in the fluid storage vessel, a flow monitoring device for monitoring the replacement pump fluid flow of the replacement pump, and an operating condition monitoring device for monitoring at least one operating condition of the power supply;

wherein the fluid level monitoring device communicates the fluid level in the fluid storage vessel to the system control, wherein the flow monitoring device communicates the fluid flow provided by the pump to the system control, and wherein the system control turns on the power supply and starts the replacement pump when the fluid level reaches a preset low level and then turns the power supply off when no fluid flow is sensed by the flow monitoring device or when the fluid flow stops for a preset time.

23. The method of claim 22 wherein the fluid is water.

24. The method of claim 22 wherein the fluid is a hydrocarbon.

* * * * *